US006044342A

United States Patent [19]

Sato et al.

[11] Patent Number: 6,044,342

[45] Date of Patent: Mar. 28, 2000

[54] SPEECH SPURT DETECTING APPARATUS AND METHOD WITH THRESHOLD ADAPTED BY NOISE AND SPEECH STATISTICS

[75] Inventors: Nobuki Sato, Hatogaya; Hiroshi Kamei, Shirai-machi; Takamasa Tomono, Kodaira; Makoto Aoki, Tokyo; Jina Baek, Funabashi, all of Japan

[73] Assignee: Logic Corporation, Tokyo, Japan

[21] Appl. No.: 08/978,481

[22] Filed: Nov. 25, 1997

[30] Foreign Application Priority Data

Jan. 20, 1997 [JP] Japan ..... 9-007865

[51] Int. Cl.[7] ..... G10L 5/06

[52] U.S. Cl. ..... 704/233; 704/240; 704/248

[58] Field of Search ..... 704/233, 248, 704/253, 226, 227, 240; 379/389, 351

[56] References Cited

U.S. PATENT DOCUMENTS

| | | | |
|---|---|---|---|
| 4,700,392 | 10/1987 | Kato et al. | 704/233 |
| 5,201,004 | 4/1993 | Fujiwara et al. | 704/233 |
| 5,485,522 | 1/1996 | Solve et al. | 381/56 |
| 5,598,466 | 1/1997 | Graumann | 379/389 |
| 5,611,019 | 3/1997 | Nakatoh et al. | 704/233 |

OTHER PUBLICATIONS

GSM Standard, Digital Cellular Telecommunications system; Voice Activity Detection (VAD) (GSM 06.32), Oct. 1996.

*Primary Examiner*—David R. Hudspeth
*Assistant Examiner*—Donald L. Storm
*Attorney, Agent, or Firm*—Sterne, Kessler, Goldstein & Fox P.L.L.C.

[57] ABSTRACT

A speech spurt detecting apparatus for detecting speech spurts in a voice signal has a storage for storing an input voice signal. A decision portion determines speech spurt sections and mute sections using a threshold value and sets one of the mute sections at a latter part of a hangover time. A mute level statistical processor estimates the noise distribution of a signal in the mute sections. A speech spurt detecting threshold value decision portion receives the average and the variance of the noise distribution from the mute level statistical processor and approximates the noise distribution to a gamma distribution to decide a speech spurt detecting threshold. A speech spurt transmitting portion outputs the voice signal in the speech spurt sections from the storage. A speech spurt level statistical processor carries out statistical processing of the speech spurt sections. The speech spurt detecting threshold value decision portion detects an error of the speech spurt detecting threshold value using the speech spurt level statistical processor and the mute level statistical processor and resets the speech spurt detecting threshold value to its initial value if the error exceeds a predetermined value. The speech spurt detecting threshold value decision portion increases the speech spurt detecting threshold value at a fixed rate in each of the speech spurt sections, and computes (the average)$^2$/(the variance) to obtain an adjusting coefficient and computes (the adjusting coefficient)×(the average) to obtain the speech spurt detecting threshold value.

10 Claims, 9 Drawing Sheets

SPEECH SPURT DETECTING
S702
SUM + |INPUT| --> SUM
S704
CNTR1 + 1 --> CNTR1
S706
CNTR1≧A
NO
YES
S708
AVEf1 --> AVEf2
S710
SUM/A --> AVEf1
S712
0 --> CNTR1
0 --> SUM
S714
AVEf1≧VAth
NO
YES
S716
DECIDE "SPEECH SPURT"
S718
0 --> HOF
S720
B --> HOCNTR
S722
(1-2^-N)AVEaf+2^-N AVEf1 -->AVEaf
S730
HOF = 0
NO
YES
S732
VAth --> VAthoc
S734
1 --> HOF
S736
HOCNTR ≧ C
YES
NO
S738
(1-2^-N)AVEiaf + 2^-N AVEf2 --> AVEiaf
S740
(1-2^-N)VARiaf+2^-N (AVEf2 + AVEiaf)^2 --> VARiaf
S742
D(AVEiaf^2/VARiaf) + E --> THcoef
S744
THcoef > F
NO
YES
S746
F --> THcoef
S770
THcoef < G
NO
YES

SPEECH SPURT DETECTING APPARATUS AND METHOD WITH THRESHOLD ADAPTED BY NOISE AND SPEECH STATISTICS

This application is based on application Ser. No. 007, 865/1997 filed Jan. 20, 1997 in Japan, the content of which is incorporated hereinto by reference.

BACKGROUND OF THE INVENTION

1. Field of the Invention

The present invention relates to a technique for extracting only speech spurt parts from a voice signal, and particularly to a technique applicable to voice packet communications, voice store processing, or the like.

2. Description of Related Art

Extracting speech spurt parts from a voice signal is utilized in communications or voice signal storing, for example, because only these parts serve as effective information of a signal to be transferred or stored. Applying this technique makes possible effective use of communications network facilities or voice storing equipment. Therefore, many approaches have been conventionally proposed as the speech spurt extracting techniques.

The conventional voice packet communications transfer only effective speech parts of voice signals in information transmission.

FIG. 1 is a block diagram showing the application of the speech spurt parts extracting technique in the voice packet communications. In FIG. 1, the reference numeral 101 designates a device for converting the voice into an electric signal (analog signal), that is, generally a telephone. The reference numeral 102 designates a packet transmitter, and 103 designates a packet receiver. The reference numeral 104 designate a device for converting the electric signal into voice, that is, a telephone in general.

The packet transmitter 102 comprises an analog-to-digital (A/D) converter 105 for converting the analog signal into a digital signal, a speech spurt detector 106 for deciding and extracting only speech spurts from the digital voice signal, and a voice packet transmitter 107 for assembling a packet by adding voice packet control information to the extracted speech spurt signal and for transmitting it to the party equipment. On the other hand, the packet receiver 103 comprises a voice packet receiver 108 for extracting a speech spurt signal from the received voice packet, a voice regenerator 109 for regenerating the speech spurt signal and a mute signal, thereby recovering the digital voice signal, and a digital-to-analog (D/A) converter 110 for converting the digital signal into an analog signal.

A voice signal 111 is composed of speech spurt signals denoted by shaded parts and mute signals denoted by unshaded parts. The voice signal is input to the packet transmitter 102 where the speech spurt detector 106 extracts the speech spurt parts. Then, as indicated by the reference numeral 112, voice packets are assembled from the voice signals in the extracted speech spurt parts and a header is added to each of them. The voice packet is restored by the packet receiver 103 from the packet signal 112 and output as a voice signal 113.

Thus, the speech spurt detector 106 extracts only the speech spurt parts of the voice uttered by a talker.

An inappropriate technique for extracting the speech spurts from the voice will result in breaks of extracted voice, or omissions of initial and/or final positions of words. This will presents a problem of degrading the voice reproduced from the extracted speech spurts.

In addition, it is necessary to take into account that the environment of the source is not always quiet but is incessantly interfered by external noise. The adverse effect of the noise presents another problem in that the noise may be misidentified as speech spurts and hence increases an extraction amount of the speech spurts, resulting in hindering an effective use of the equipment in spite of its purpose that only significant speech spurts should be detected. It is further necessary to consider the fact that the noise levels fluctuate every moment.

To solve these problems, various proposals have been made which are roughly divided into:

(1) A method of setting a speech spurt level in advance, and identifying that signals exceeding the level are speech spurts.

(2) A method of detecting voices considering a zero-cross frequency with utilizing the difference in frequencies between a signal and noise to distinguish voices from noise.

(3) A method of detecting voices using a combination of (1) and (2).

Although the foregoing conventional techniques are effective to some extent in distinguishing voices from noise, sounds with a wide frequency range like musical sounds contained in an audio signal can be misidentified as noise by the foregoing method (3), for example.

In particular, it is not rare in practice that musical sounds (for example, a call holding sound of a telephone) are mixed in the audio signal excluding the case of speech recognition and production. In view of this, the speech spurts must be extracted from environmental sounds including musical sounds.

SUMMARY OF THE INVENTION

It is therefore an object of the present invention to provide a speech spurt detecting apparatus and method which can extract effective voices (speech spurt parts) with suppressing the effect of external noise from a source including musical sounds besides voices, thus solving the problems of the conventional techniques.

In a first aspect of the present invention, there is provided a speech spurt detecting apparatus for detecting speech spurts in a voice signal, the speech spurt detecting apparatus comprising:

a storage for storing an input voice signal;

a decision portion for making a decision of speech spurt sections and mute sections from the input voice signal using a threshold value;

a mute level statistical processor for estimating noise distribution of a signal in the mute sections by statistically processing the mute sections decided by the decision portion;

a speech spurt detecting threshold value decision portion for deciding a speech spurt detecting threshold value considering the noise distribution such that the threshold value is unaffected by noise; and a speech spurt transfer portion for outputting from the storage the voice signal in the speech spurt sections.

Here, the speech spurt detecting threshold value decision portion may increase at a fixed rate the speech spurt detecting threshold value in each of the speech spurt sections.

The decision portion may decide a portion with its level lower than the threshold value as one of the mute sections, and may set one of the mute sections at a latter part of a hangover time.

The speech spurt detecting apparatus may further comprise a speech spurt level statistical processor for carrying out statistical processing of the speech spurt sections, wherein the speech spurt detecting threshold value decision portion detects an error of the speech spurt detecting threshold value using the speech spurt level statistical processor and the mute level statistical processor, and resets the speech spurt detecting threshold value to its initial value if the error exceeds a predetermined value.

In a second aspect of the present invention, there is provided a speech spurt detecting method for detecting speech spurts in a voice signal, the speech spurt detecting method comprising the steps of:

storing an input voice signal;

making a decision of speech spurt sections and mute sections from the input voice signal using a threshold value;

estimating noise distribution of a signal in the mute sections by statistically processing the mute sections;

deciding a speech spurt detecting threshold value considering the noise distribution such that the threshold value is unaffected by noise; and outputting the voice signal in the speech spurt sections from the stored voice signal.

The foregoing configurations of the present invention fall into the foregoing item (1): A method of setting a speech spurt level in advance, and identifying that voices exceeding the level are speech spurts.

The present invention in this division has the following characteristics:

(a) The present invention dynamically varies the speech spurt detecting threshold value in response to the input signal.

(b) The dynamic variation in the speech spurt detecting threshold value is determined by statistically processing the noise characteristics in mute sections.

(c) Considering the changes in the environment of a sound source, the mute sections to be statistically processed are assumed as a rule to have a level below the speech spurt detecting threshold value in an initial state, whereas they are selected during a hangover time from its latter part in which it is highly probable that the voice has been nearly extinguished.

(d) An error in the statistical processing is identified, and if it matches a particular condition, it is initialized.

The speech spurt detection in accordance with the present invention can extract only speech spurts from an audio signal even if external noise varies or the audio signal includes musical sounds besides speech sounds. This makes it possible to make effective use of resources such as communication systems or voice storing apparatus using the voice information.

The present invention has a wide scope of application because it can handle various kinds of sounds without being limited by the sources of audio signals. As a result, it has large effect on various systems in actual operation.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

The invention will now be described with reference to the accompanying drawings.

The embodiments of the present invention will be described in connection with the voice packet communications system described above with reference to FIG. 1.

Figure 1:
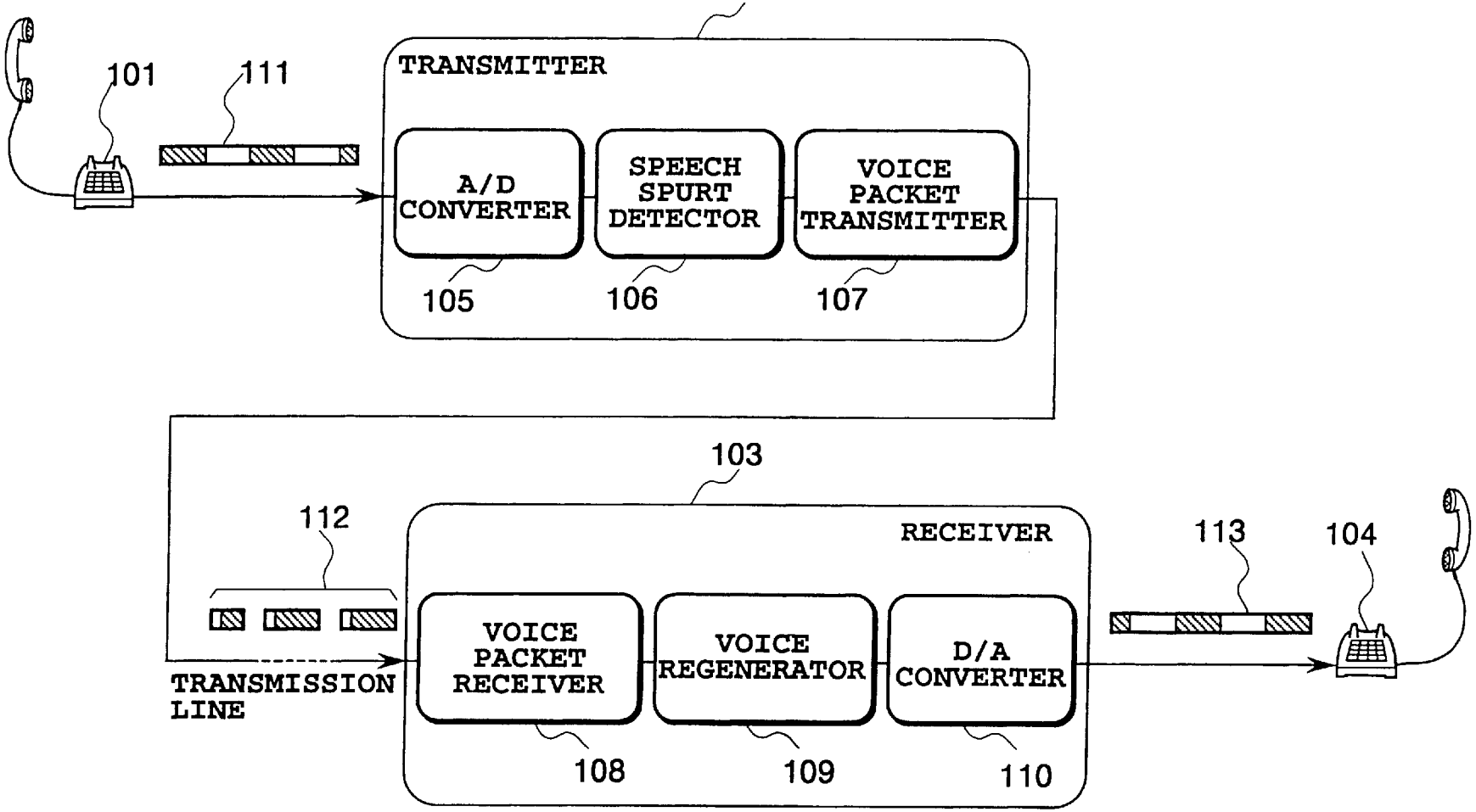
FIG.1 (PRIOR ART)
FIG. 1 is a block diagram showing a configuration of a voice packet communications.
Figure 2:
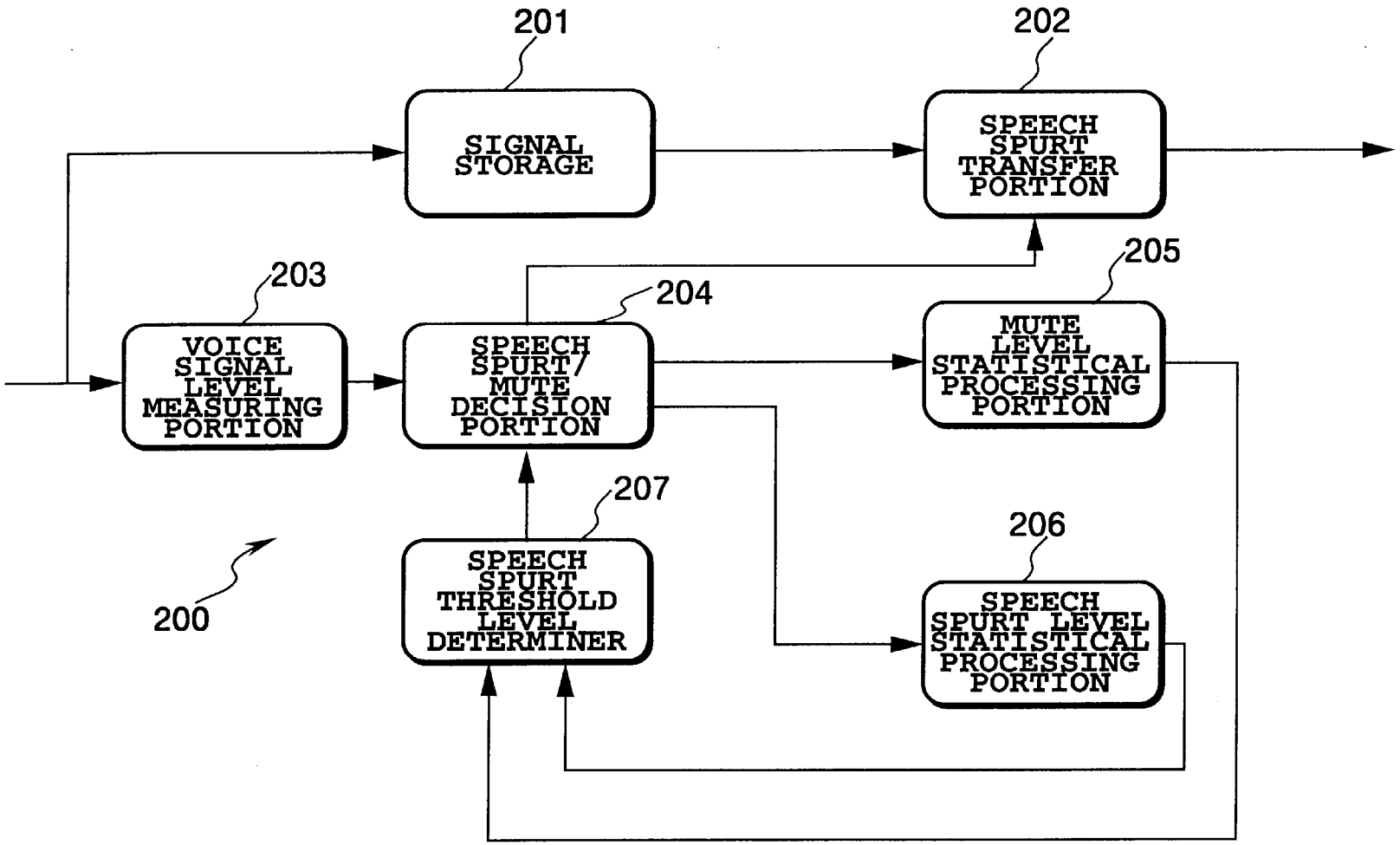
FIG. 2 is a block diagram showing an embodiment of a speech spurt detecting apparatus in accordance with the present invention.

FIG. 2 is a block diagram showing a configuration of a speech spurt detector 200 of the present invention. The speech spurt detector 200 corresponds to the speech spurt detector 106 in the voice packet communications system as shown in FIG. 1.

In FIG. 2, the reference numeral 201 designates a signal storage which temporarily stores an input digital voice signal, and outputs it only during speech spurt sections and hangover times as effective information.

The reference numeral 202 designates a speech spurt transfer portion for supplying the signal stored in the signal storage 201 to the voice packet transmitter 107 if the signal is decided as speech spurts. The reference numeral 203 designates a voice signal level measuring portion for measuring an average absolute voice level (called a section absolute average value below) in a time unit from the digital voice signal fed from the analog-to-digital converter 105. The measured levels become a subject of the speech spurt/mute decision. The reference numeral 204 designates a speech spurt/mute decision portion which compares the measured signal with the speech spurt detecting threshold value determined by a statistical processing of previously measured signals to determine whether the measured signal levels correspond to the speech spurt, hangover or mute. The reference numeral 205 designates a mute level statistical processing portion that obtains the average and variance of the signal levels in a mute section, and estimates the level distribution of the signal. The reference numeral 206 designates a speech spurt level statistical processing portion for obtaining the average of the signal levels in a speech spurt section. The reference numeral 207 designates a speech spurt threshold value determining portion 207 for determining the speech spurt detecting threshold value from the statistical information fed from the mute level statistical processing portion 205 and speech spurt level statistical processing portion 206.

The operation of the apparatus will now be described.

The digital voice signal is input every 125 microseconds in the case of telephone speech. The signal is stored in the signal storage 201 and input to the voice signal level measuring portion 203 at the same time. The voice signal level measuring portion 203 calculates the "section absolute average value" of the signal in any observation time, every 16 milliseconds, for example. The section absolute average value is supplied to the speech spurt/mute decision portion 204 every observation time interval. The speech spurt/mute decision portion 204 compares the section absolute average value with the threshold value determining portion by the speech spurt threshold value determiner 207 before the current section, makes a decision whether the signal is to be output as the speech spurt or hangover, and notifies the speech spurt transfer portion 202 of the result. The speech spurt transfer portion 202 sends the signal in the current observation section stored in the signal storage 201 in the case of the speech spurt or hangover, whereas that signal is not sent in the case of the mute, resulting in discarding the signal in the current observation section.

So far is the control flow of the transfer of the voice signal. Next, techniques of determining the threshold value will be described.

The "section absolute average value" which is input to the speech spurt/mute detecting portion 204 is delivered to the speech spurt level statistical processing portion 206 when the decision result is speech spurt, and is sent to the mute level statistical processing portion 205 when the decision result is mute or a latter part of the hangover time (called an observation window section of the hangover from now on). When the decision result is speech spurt, the speech spurt level statistical processing portion 206 statistically computes the average value of the speech spurt levels. ON the other hand, when the decision result is mute or observation window section of the hangover, the mute level statistical processing portion 205 computes the statistics such as average and variance which are main factors for determining the threshold value. These values computed by the mute level statistical processing portion 205 and speech spurt level statistical processing portion 206 are supplied to the speech spurt threshold value determining portion 207 to be used for determining the threshold value of the next observation and afterward. Thus, in determining the threshold value, the signal levels in the mute section, in the observation window section of the hangover and in the speech spurt section are fed back in the statistically processed form.

The foregoing description is about the decision method of the speech spurt threshold value in the mute sections. However, the decision method of the speech spurt threshold value in the speech spurt differs from that. The speech spurt detecting threshold value in the speech spurts is determined such that it increases in a fixed rate if the speech spurt section exceeds a particular time period. The purpose of increasing the speech spurt detecting threshold value in the speech spurt section is to extract only really effective speech spurts by setting the level as high as possible above the noise level.

Next, referring to FIGS. 3, 4 and 5, the following items and their relationships will be described in more detail: the definition of the mute section and the speech spurt section; the algorithm for determining the speech spurt detecting threshold value; and a behavioral example of the speech spurt detecting threshold value in the speech spurt sections and mute sections.

Figure 3:
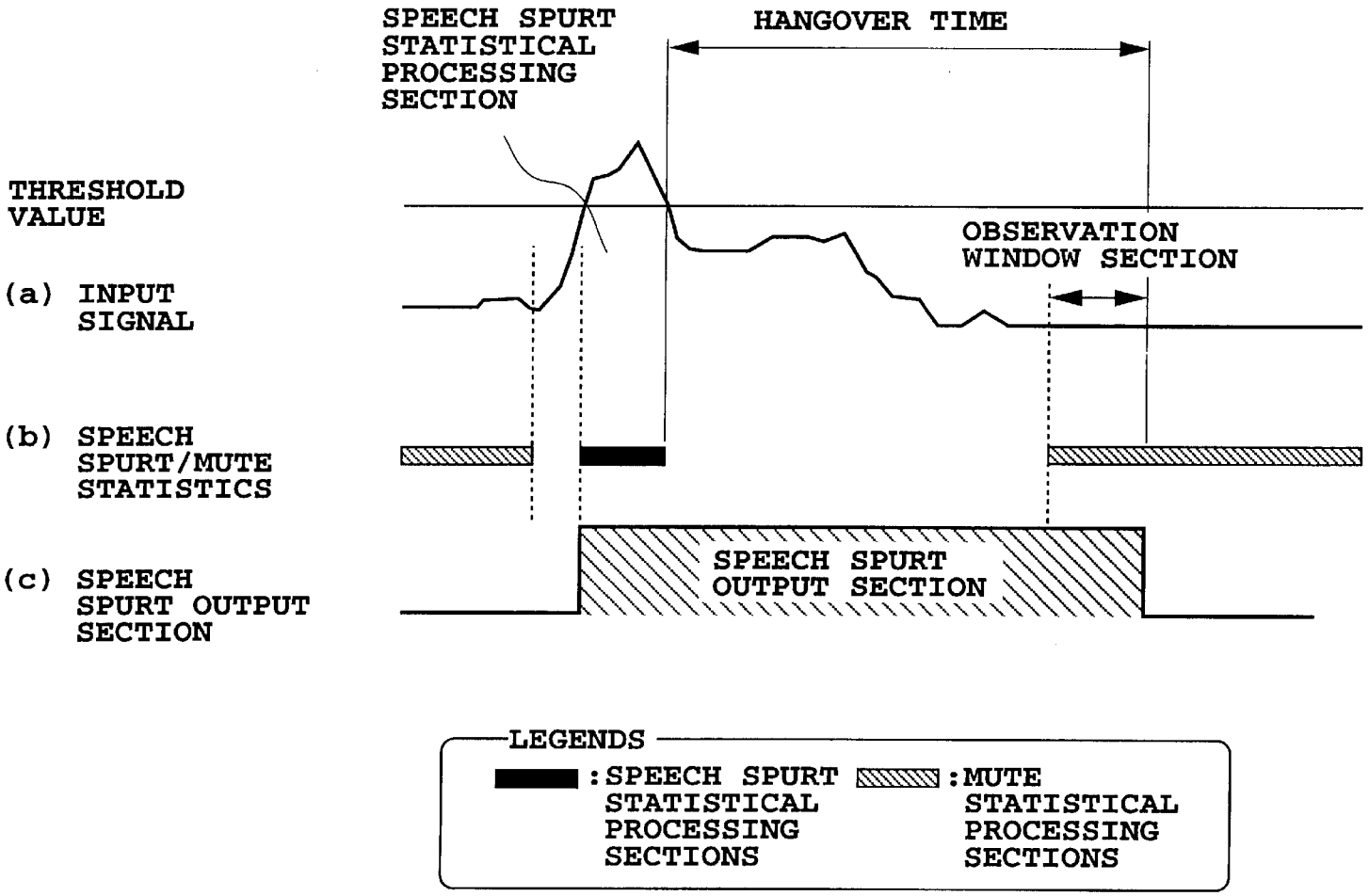
FIG. 3 is a diagram illustrating relationships between an input signal (signal to be measured) and a statistical processing section of speech spurt and mute which are decided from the speech spurt detecting threshold value.

FIG. 3 is a graph illustrating the relationships between the input signal (signal to be measured) and statistical processing section of speech spurt and mute sections determined from the speech spurt detecting threshold value. As shown in FIG. 3, the part of the measured signal (input signal) whose amplitude is greater than the speech spurt detecting threshold value is handled as the speech spurt statistical processing section. On the other hand, although the mute statistical processing section is targeted in principle for the part whose amplitude is less than the speech spurt detecting threshold value, it includes a later portion of the hangover time (usually a fixed interval) which is handled as a speech spurt output interval, and in addition, a portion immediately prior to the speech spurt is excluded from the mute/speech spurt statistics. This is important: The latter part of the hangover time can be included in the mute statistical processing section because the hangover time is set for preventing the break of the voice signal in a final part of a word, and hence it contains little voice. In addition, the part immediately before the speech spurt is excluded from the statistic to reduce the error of the statistics as small as possible. In this way, the speech spurt detecting threshold value can be converged to an appropriate level even if it differs extremely in the initial state of the observation. Thus, the speech spurt and mute statistical processing sections are determined from the measured signal and speech spurt detecting threshold value.

Figure 4:
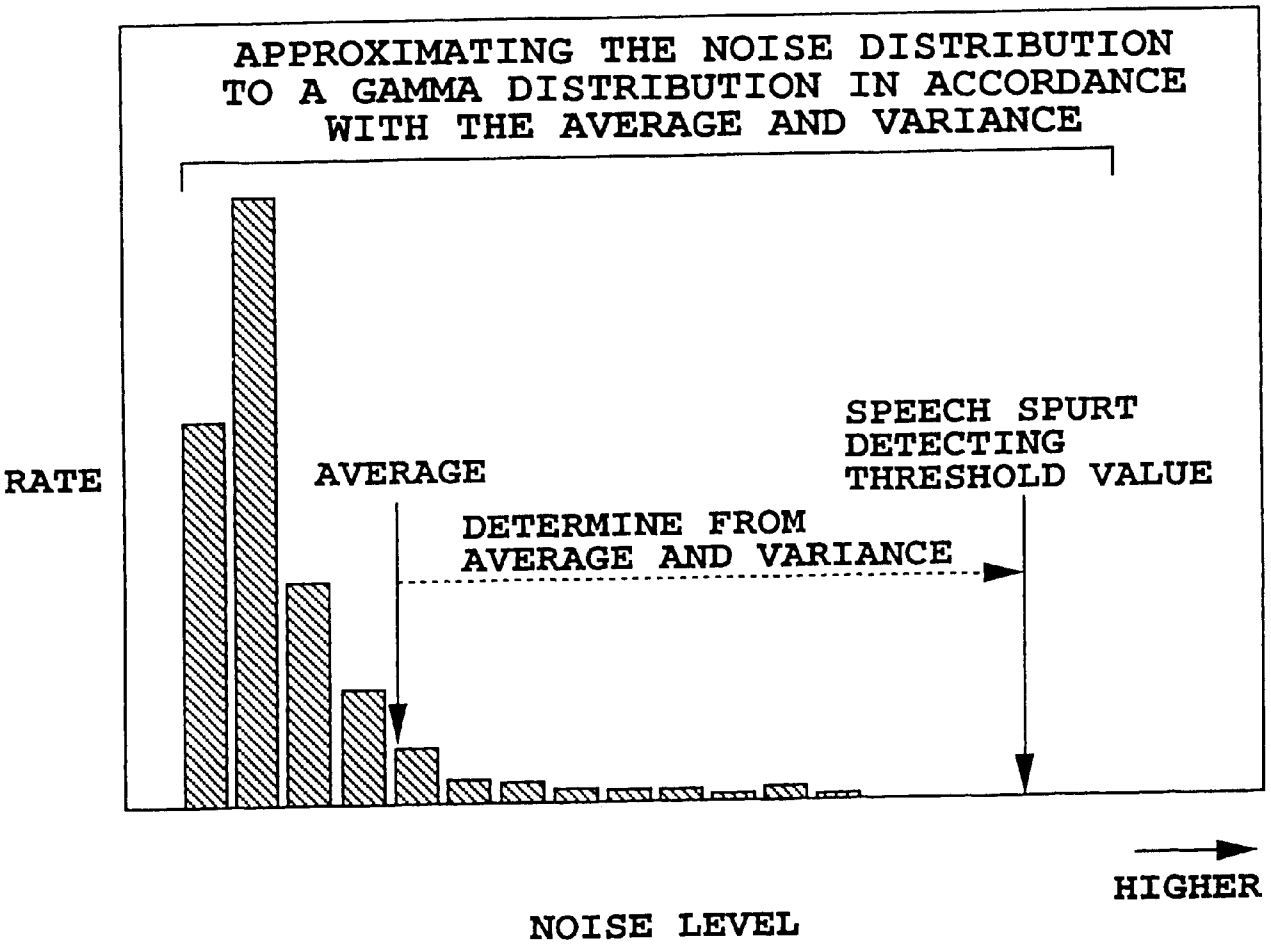
FIG. 4 is a graph illustrating relationships between noise distribution and speech spurt detecting threshold value in the mute statistical processing sections.

FIG. 4 is a graph illustrating the relationships between the noise distribution and a speech spurt detecting threshold value in the mute statistical processing section.

The speech spurt detecting threshold value must be set substantially higher than the mute signal level to eliminate the effect of the noise. Considering this, the average and variance of the signal level distribution in the mute section are measured to estimate the distribution. The statistical processing approximates the noise distribution by a $\Gamma$ distribution, determines the order k (=average$^2$/variance) from the average and variance, and determines the noise distribution. Furthermore, conditions unaffected by noise are estimated from probabilistic factors to determine the speech spurt detecting threshold value. Usually, the speech spurt detecting threshold value can be determined thus, which is shown in the graph of FIG. 4.

To distinguish the musical sounds from noise, the variance can be utilized because the signal level of the musical sounds swings larger than noise. More specifically, comparing the noise and musical sounds, in the case of noise, the speech spurt detecting threshold value becomes more stable with smaller fluctuations as it increases, and its order k increase, whereas in the case of musical sounds, it tends to grow larger than the average value of the speech spurt signal and has lower order k, thereby enabling their distinction. As easily understood, it is difficult to distinguish the voice in conjunction with background music from noise, and they are extracted as the speech spurts in most cases. However, when the voice level is larger than the background music level, the musical sounds are handled as noise.

If the musical sounds continue for a long time, an increasing error will appear in a mute section measurement signal because of the latter part of the hangover time handled as the mute section. Correction of the error is carried out by referring to the average of the speech spurt signal level in the speech spurt statistical processing section and by comparing the threshold value obtained from the statistical processing of the mute section. As a guide for correction, the variables obtained up to now are initialized when the average in the speech spurt statistical processing section approaches the speech spurt detecting threshold value obtained in the mute statistical processing section, and the order k is rather small. This makes it possible to prevent the speech spurt signal from being misidentified as mute by the speech spurt detecting threshold value depending on the types of the error.

Figure 5:
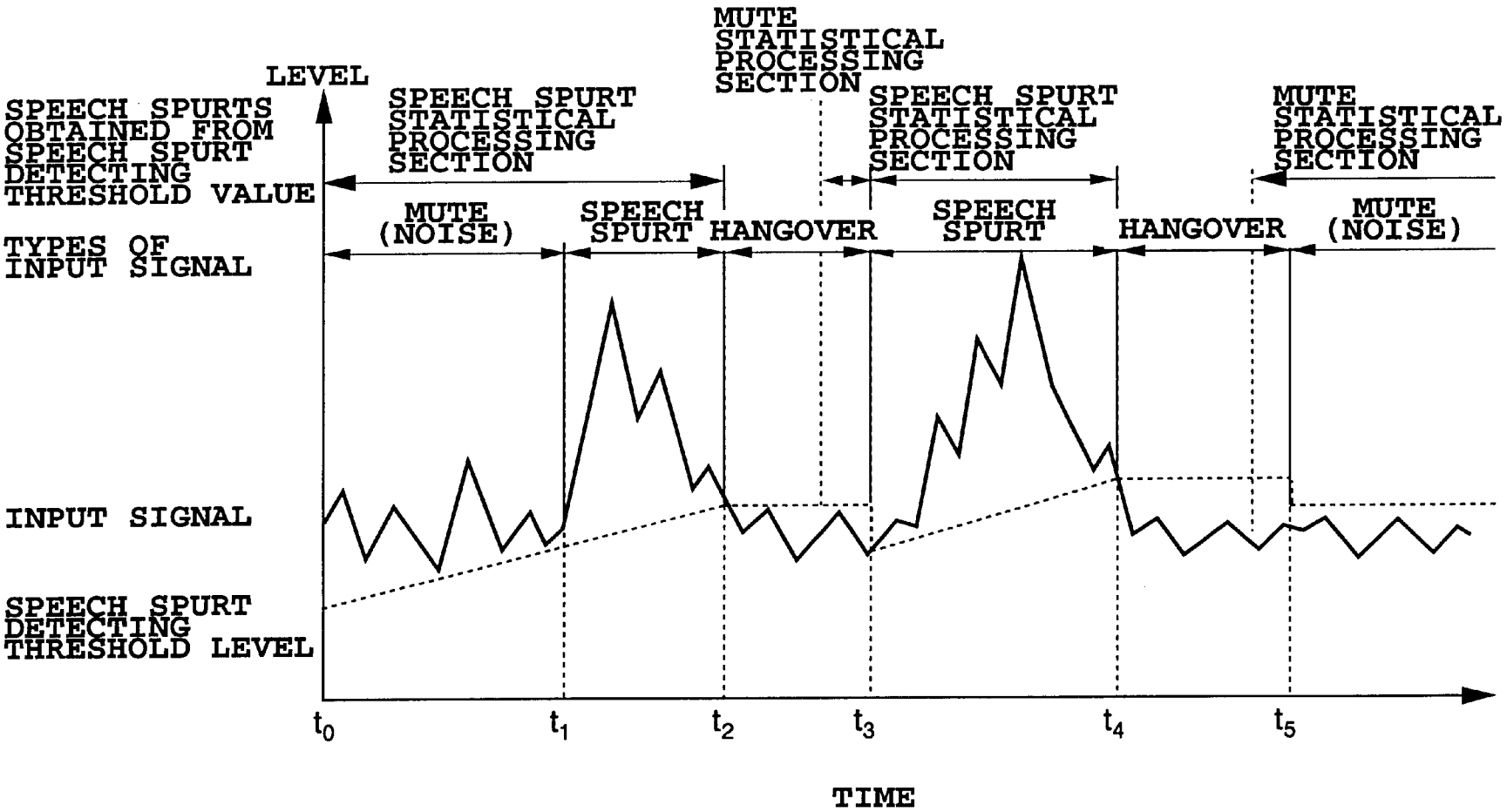
FIG. 5 is a graph illustrating relationships between a voice signal average level and the speech spurt detecting threshold values.

FIG. 5 illustrates a model of the average voice signal level (the output of the voice signal level measuring portion 203) and the behavior of the speech-spurt detecting threshold value. Generally, it is preferable that the initial value of the speech spurt detecting threshold value be set at rather low so that the speech spurts are not misidentified as a mute. Considering this, at the initial stage of elapsed time (t0–t1), almost all sounds including noise are detected as the speech spurts. If this state remains unchanged, the noise will be continually identified as the speech spurt. Taking account of this, the speech spurt detecting threshold value is gradually increased in the speech spurt section. This is particularly effective when the ambient noise level of the source is high.

If the increasing speech spurt detecting threshold value reaches the voice signal level, it crosses the voice signal level, resulting in the voice signal whose level is lower than the speech spurt detecting threshold value, and a transition interval (t2–t3) from the speech spurt to the mute becomes the hangover time. The hangover is provided for smooth regeneration of the voice by handling it as the speech spurt when the voice transits from the speech spurt to mute. If a sufficient hangover time is taken, its latter part is thought to be scarcely including voice, and hence part of the latter part is subjected to the mute section statistics. This enables the mute section statistics to be gradually carried out, and the speech spurt detecting threshold value to be finally set at a desirable level.

When the speech spurt detecting threshold value exceeds the noise level, the statistical information in the mute section can be obtained accurately. Accordingly, the speech spurt detecting threshold value can be determined from the noise distribution estimated from its average and variance, thereby enabling only the voice to be extracted as effective information.

Thus dynamically controlling the speech spurt detecting threshold value can achieve effective detection and extraction of the speech spurts without being largely affected by the external noise level.

Figure 6:
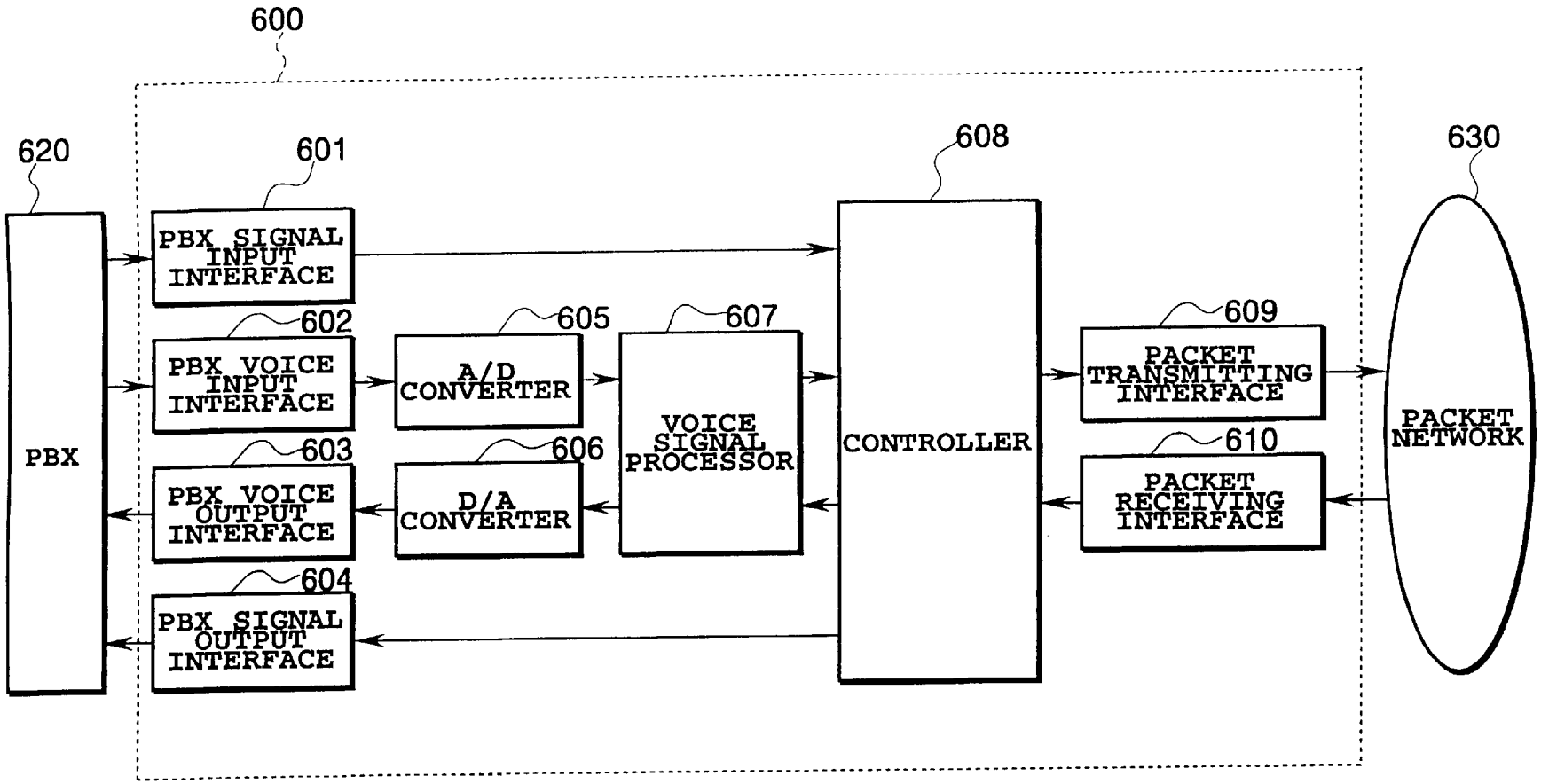
FIG. 6 is a block diagram showing a configuration of a voice multiplex apparatus in accordance with the present invention.

FIG. 6 shows a voice packet multiplexer 600 installed between a packet network 630 and a PBX (private branch exchange) 620. The voice packet multiplexer 600 bears voices on multiple packets, and multiplexes them to be sent to the packet network 630. On the other hand, receiving multiplexed packets from the packet network 630, it regenerates voice signals from the packets and sends them to the PBX 620. The voice packet multiplexer 600 can carry out the above-described speech spurt detection.

In FIG. 6, the reference numerals 601–604 designate interfaces for interfacing with the PBX 620. In particular, the interface of the voice signal is carried out by the PBX voice input interface 602 and PBX voice output interface 603. The voice signals from the PBX 620 are fed through the PBX voice input interface 602 to an A/D converter 605 which converts them into digital voice signals, and supplies them to a voice signal processor 607. The voice signal processor 607 performs the above-described speech spurt detection. The digital voice signals processed by the voice signal processor 607 are formed into packets by a controller 608, and are sent to the packet network 630 through a packet transmitting interface 609.

The packets received by a packet receiving interface 610 from the packet network 630 are fed to the controller 608 which extracts the voice signals from the packets. The voice signals processed by the voice signal processor 607 are converted into analog signals by a D/A converter 606, and are sent to the PBX 620 through the PBX voice output interface 603.

The voice signal processor 607 can be implemented by a digital signal processor (DSP), and the controller 608 can be constructed by a general purpose processor.

An example of the foregoing speech spurt detection processing in the voice signal processor composed of a DSP or the like will now be described in detail with reference to the flowchart shown in FIG. 7.

Figures 7, 7A, 7B:
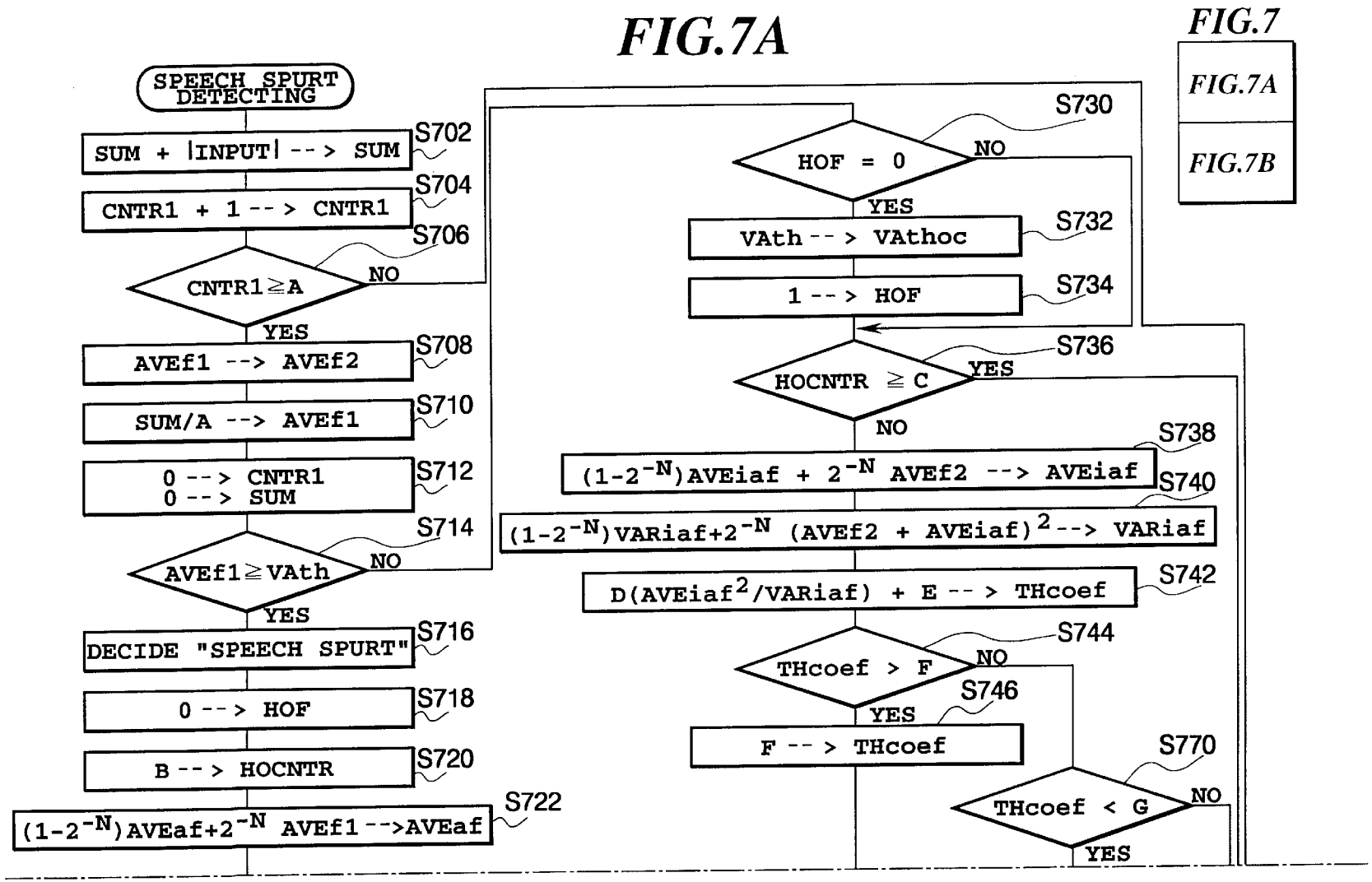
FIG. 7 is a diagram showing the relationship of FIGS. 7A and 7B.
FIG. 7A is a flowchart illustrating a processing example of speech spurt detection in accordance with the present invention.
FIG. 7B is a flowchart illustrating a processing example of speech spurt detection in accordance with the present invention.
Figure 7B:
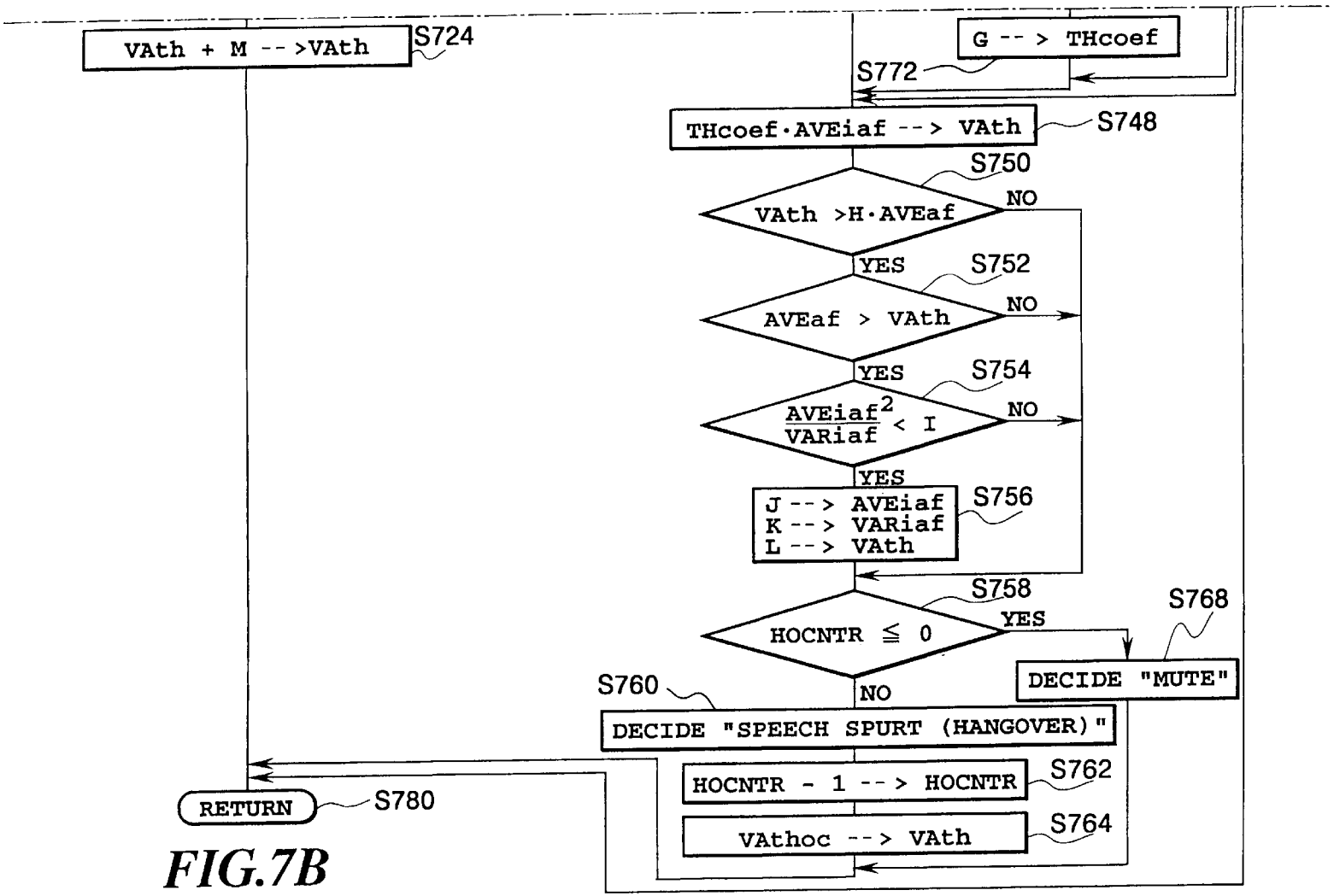

In the flowchart of FIG. 7, the following symbols are used.

[Variables]

input: digital voice signal.

Sum: sum total of the absolute values of the digital voice signal.

CNTR1: count of input digital voice signals.

AVEf1: section absolute average value.

AVEf2: section absolute average value computed previously.

VAth: speech spurt detecting threshold value.

HOF: flag for holding speech spurt detecting threshold value.

AVEaf: average of speech spurt level.

VAthoc: threshold value during hangover compensation.

HOCNTR; hangover compensation counter.

AVEiaf: average of mute signal level.

VARiaf: variance of mute signal level.

THcoef: speech spurt threshold value adjusting coefficient.

[Constants]

A: constant for determining an observation time of the section absolute average value, where the observation time of the section absolute average value=125 microseconds×A.

B: initial value of the hangover compensation counter (HOCNTR), where hangover time=125 microseconds×A×B.

C: constant for determining a hangover section included in the mute statistical processing section, where the hangover section included in the mute statistical processing section=125 microsecond×A×C.

D: parameter used for computing the threshold value adjusting coefficient.

E: parameter used for computing the threshold value adjusting coefficient.

F: upper limit used for computing the threshold value adjusting coefficient.

G: lower limit used for computing the threshold value adjusting coefficient.

H: parameter for initialization condition.

I: parameter for initialization condition.

J: initial value of the average (AVEiaf) of the mute signal level.

K: initial value of the variance (VARiaf) of the mute signal level.

L: initial value of the speech spurt detecting threshold value (VAth).

M: rate for increasing the speech spurt detecting threshold value during speech spurt section.

N: sensitivity adjusting coefficient.

In FIG. 7, receiving a digital voice signal (input) at every 125 microsecond interval, the voice signal processor 607 adds its absolute value to the sum total (SUM) at step S702. Incrementing the count 1 which counts the time at step S704, the voice signal processor 607 checks if the time (observation time A) has elapsed for computing the average value at step S706. If the observation time has not elapsed, the processing returns to step S780.

If the observation time has elapsed, the voice signal processor 607 stores the previous average value to AVEf2 at step S708, and computes the current average value to be stored in AVEf1 at step S710. Then, the voice signal processor 607 initializes the time counter CNTR1 and the sum total SUM at step S712. Thus, the level of the voice signal has been stored in the AVEf1.

The voice signal processor 607 compares the voice signal level AVEf1 with the speech spurt detecting threshold value Vath at step S714, and decides it as a speech spurt if it exceeds the speech spurt detecting threshold value at step S716.

Deciding it as the speech spurt, the voice signal processor 607 substitutes zero into the flag HOF at step S718, initializes the hangover compensation counter HOCNTR at step 720, and carries out the statistical processing of the speech spurt level at step S722. The average of the speech spurt level AVEaf is computed in accordance with the following expression (1).

$$(1-2^{-N})\mathrm{AVEaf}+2^{-N}\mathrm{AVEf1} \quad (1)$$

Its result is stored in the AVEaf. Then, the voice signal processor 607 increments the speech spurt detecting threshold value in the speech spurt section at step S724, leaving the processing at step S780.

Deciding the voice signal as non-speech spurt, the voice signal processor 607 checks if the flag HOF is zero at step S730. Since the flag HOF of zero indicates transition from the speech spurt state to the mute state, the voice signal processor 607 substitutes the speech spurt detecting threshold value (VAth) into the hangover compensation threshold value Vathoc at step S732, and sets the flag HOF at one. In the case where the flag HOF is one, the voice signal processor 607 skips the foregoing processing because it indicates the mute state.

Then, the voice signal processor 607 checks at step S736 whether the current state is in the hangover section in which the mute statistical processing should be carried out. If it is out of the hangover section (YES at step S736), the voice signal processor 607 proceeds to step S748, skipping the mute level statistical processing.

If it is in the hangover section to carry out the mute statistical processing (NO at step S736), the voice signal processor 607 performs the statistical processing of the mute levels. The voice signal processor 607 computes the average AVEiaf and variance VARiaf of the mute levels at steps S738 and S740, and obtains the speech spurt detecting threshold value adjusting coefficient Thcoef from the computed average AVEiaf and variance VARiaf. These values are computed by the following expressions (2)–(4), respectively.

$$(1-2^{-N})\mathrm{AVEiaf}+2^{-N}\mathrm{AVEf2} \quad (2)$$

$$(1-2^{-N})\mathrm{VARiaf}+2^{-N}(\mathrm{AVEf2}+\mathrm{AVEiaf})^2 \quad (3)$$

$$D(\mathrm{AVAiaf}^2/\mathrm{VARiaf})+E \quad (4)$$

Comparing the computed speech spurt detecting threshold value adjusting coefficient Thcoef with the upper limit value F at step S744, the voice signal processor 607 sets the new upper limit value at step S746 if it exceeds the upper limit value. Likewise, comparing the computed speech spurt detecting threshold value adjusting coefficient THcoef with the lower limit value G at step S770, the voice signal processor 607 sets the new lower limit value at step S772 if it is lower than the lower limit value.

Using the speech spurt detecting threshold value adjusting coefficient THcoef obtained by the statistical processing, the voice signal processor 607 computes the speech spurt detecting threshold value AVth at step S748 by the following expression (5).

$$\mathrm{THcoef}\cdot\mathrm{AVEiaf} \quad (5)$$

In addition, checking at steps S750, S752 and S754 whether to initialize the average and variance of the mute signal level, and the speech spurt detecting threshold value, the voice signal processor 607 initializes them at step S756 if the following conditions (6)–(8) are all satisfied.

$$\mathrm{VAth}>\mathrm{H}\cdot\mathrm{AVEaf} \quad (6)$$

$$\mathrm{AVEaf}>\mathrm{VAth} \quad (7)$$

$$\mathrm{AVEiaf}^2/\mathrm{VARiaf}<\mathrm{I} \quad (8)$$

Afterward, if the current state is in the hangover time (YES at step S758), the voice signal processor 607 makes a decision that it is in the speech spurt (hangover), decrements the hangover compensation counter HOCNTR at step S762, and replaces the speech spurt detecting threshold value VAth with the one during the hangover, thus exiting from this process at step S780.

If the current state is not in the hangover time (NO at step S758), the voice signal processor 607 makes a decision that it is in the mute state at step S768, thus exiting from this processing at step S780.

Figure 8:
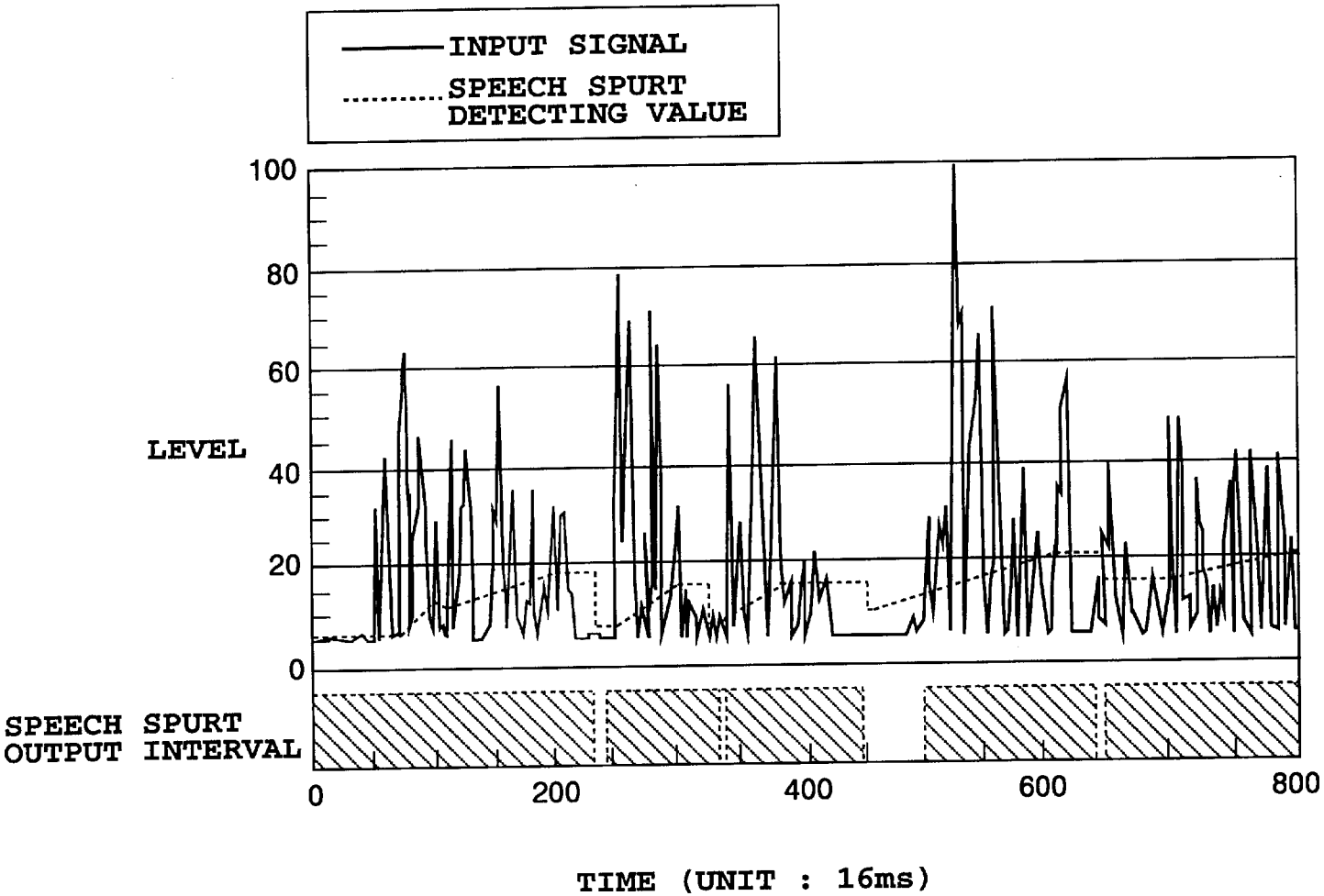
FIG. 8 is a graph obtained as a result of computer simulation of the speech spurt detection in accordance with the present invention.

FIG. 8 is a graph illustrating results of experimentally confirming using computer simulation the speech spurt detection operation in accordance with the present invention. This example uses the voice of a weather forecast presented through a telephone as an input voice signal.

The graph of FIG. 8 shows that almost all sounds are detected as the speech spurts at the initial stage of the observation because of a low speech spurt detecting threshold value. It is also seen that the speech spurt detecting threshold value approaches an appropriate one after a certain time has elapsed and the statistical processing information has been accumulated for the mute and speech spurt sections. Thus, using the speech spurt detection in accordance with the present invention makes it possible to detect only the speech spurts with high accuracy.

The speech spurt detection in accordance with the present invention can be applied not only to the foregoing voice packet communications, but also to the voice storing processing or the like processings which require to extract only significant speech spurts.

According to the present invention in which the speech spurt detecting threshold value dynamically follows the signal levels of the speech spurt and mute sections, the speech spurt sections can be accurately detected without considering the types of sound sources and their ambient effects, as in the case where musical sounds are mixed in the voice signal.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A speech spurt detecting apparatus for detecting speech spurts in a voice signal, said speech spurt detecting apparatus comprising:

a storage for storing an input voice signal;

a decision portion for making a decision of speech spurt sections and mute sections from the input voice signal using a threshold value;

a mute level statistical processor for estimating noise distribution of a signal in the mute sections by statistically processing the mute sections decided by the decision portion;

a speech spurt detecting threshold value decision portion for obtaining an average and a variance of the noise distribution from said mute level statistical processor and for approximating the noise distribution to a gamma distribution in accordance with said average and said variance to decide a speech spurt detecting threshold value in such a way that the possibility of erroneously detecting noise as a speech signal is lowered; and a speech spurt transmitting portion for outputting the voice signal in the speech spurt sections from the storage.

2. The speech spurt detecting apparatus as claimed in claim 1, wherein said speech spurt detecting threshold value decision portion increases at a fixed rate the speech spurt detecting threshold value in each of the speech spurt sections.

3. The speech spurt detecting apparatus as claimed in claim 1, wherein said decision portion decides a portion with its level lower than the threshold value as one of said mute sections, and sets one of the mute sections at a latter part of a hangover time.

4. The speech spurt detecting apparatus as claimed in claim 3, further comprising a speech spurt level statistical processor for carrying out statistical processing of the speech spurt sections, wherein said speech spurt detecting threshold value decision portion detects an error of the speech spurt detecting threshold value using said speech spurt level statistical processor and said mute level statistical processor, and resets the speech spurt detecting threshold value to its initial value if the error exceeds a predetermined value.

5. The speech spurt detecting apparatus as claimed in claim 1, wherein said speech spurt detecting threshold value decision portion computes (the average)$^2$/(the variance) to obtain a speech spurt detecting threshold value adjusting coefficient and computes (the speech spurt detecting threshold value adjusting coefficient)×(the average) to obtain said speech spurt detecting threshold value.

6. The speech spurt detecting apparatus as claimed in claim 1, wherein said decision portion has a portion having a level lower than said threshold value as a mute section, a predetermined section of said mute section from the beginning of said mute section is treated as a spurt section, and a predetermined last portion of said spurt section is subject to statistical processing by said mute level statistical processor.

7. A speech spurt detecting apparatus for detecting speech spurts in a voice signal, said speech spurt detecting apparatus comprising:

a storage for storing an input voice signal;

a decision portion for making a decision of speech spurt sections and mute sections from the input voice signal using a threshold value;

a mute level statistical processor for estimating noise distribution of a signal in the mute sections by statistically processing the mute sections decided by the decision portion;

a speech spurt detecting threshold value decision portion for deciding a speech spurt detecting threshold value considering the noise distribution such that the threshold value is unaffected by noise, wherein said speech spurt detecting threshold value decision portion increases at a fixed rate the speech spurt detecting threshold value in each of the speech spurt sections; and a speech spurt transfer portion for outputting from the storage the voice signal in the speech spurt sections.

8. A speech spurt detecting apparatus for detecting speech spurts in a voice signal, said speech spurt detecting apparatus comprising:

a storage for storing an input voice signal;

a decision portion for making a decision of speech spurt sections and mute sections from the input voice signal using a threshold value, wherein said decision portion decides a portion with its level lower than the threshold value as one of said mute sections, and sets one of the mute sections at a latter part of a hangover time;

a mute level statistical processor for estimating noise distribution of a signal in the mute sections by statistically processing the mute sections decided by the decision portion;

a speech spurt detecting threshold value decision portion for deciding a speech spurt detecting threshold value considering the noise distribution such that the threshold value is unaffected by noise;

a speech spurt transfer portion for outputting from the storage the voice signal in the speech spurt sections; and a speech spurt level statistical processor for carrying out statistical processing of the speech spurt sections, wherein said speech spurt detecting threshold value decision portion detects an error of the speech spurt detecting threshold value using said speech spurt level statistical processor and said mute level statistical processor, and resets the speech spurt detecting threshold value to its initial value if the error exceeds a predetermined value.

9. A speech spurt detecting method for detecting speech spurts in a voice signal, said speech spurt detecting method comprising the steps of:

storing an input voice signal;

making a decision of speech spurt sections and mute sections from the input voice signal using a threshold value;

estimating noise distribution of a signal in the mute sections by statistically processing the mute sections;

deciding a speech spurt detecting threshold value considering the noise distribution such that the possibility of erroneously detecting noise as a speech signal is lowered;

obtaining an average and a variance of the noise distribution from said mute level statistical processor and approximating the noise distribution to a gamma distribution in accordance with said average and said variance to decide a speech spurt detecting threshold value in such a way that the possibility of erroneously detecting noise as a speech signal is lowered; and outputting the voice signal in the speech spurt sections from the stored voice signal.

10. The speech spurt detecting apparatus as claimed in claim 9, wherein said speech spurt detecting threshold value is decided in a manner that a probability of erroneously detecting noise as a speech signal is lower than a predetermined value.

* * * * *